United States Patent [19]

Davison

[11] 4,416,199

[45] Nov. 22, 1983

[54] MULTICOLOR IMPRINTER

[75] Inventor: Charles F. Davison, Brookfield, Ill.

[73] Assignee: Norwood Marking & Equipment Co., Inc., Downers Grove, Ill.

[21] Appl. No.: 413,705

[22] Filed: Sep. 1, 1982

[51] Int. Cl.[3] ..... B41J 35/24; B41F 1/10

[52] U.S. Cl. ..... 101/193; 101/27; 400/206.4; 400/248

[58] Field of Search ..... 400/204, 206, 206.4, 400/120, 248, 214; 101/27, 202, 198, 193, 336

[56] References Cited

U.S. PATENT DOCUMENTS

| | | | |
|---|---|---|---|
| 933,652 | 9/1909 | Latta | 400/214 |
| 944,735 | 12/1909 | Latta | 400/214 |
| 1,030,500 | 6/1912 | Brown | 400/214 |
| 1,035,197 | 8/1912 | King et al. | 400/206.4 |
| 1,490,083 | 4/1924 | Barnett | 101/202 X |
| 1,654,906 | 1/1928 | Waldheim | 400/206 |
| 2,065,690 | 12/1936 | Gould et al. | 101/193 |
| 2,128,267 | 8/1938 | Sacerdote | 400/206.4 X |
| 3,004,486 | 10/1961 | Typrowicz | 101/193 |
| 3,432,022 | 3/1969 | Priebs | 400/214 X |
| 3,537,392 | 11/1970 | Ikuss | 101/198 |
| 3,878,776 | 4/1975 | Schneider | 101/27 X |
| 4,160,410 | 7/1979 | Fichter | 101/27 X |
| 4,313,376 | 2/1982 | Swoye et al. | 101/27 |
| 4,318,340 | 3/1982 | Shenoha et al. | 101/27 |

OTHER PUBLICATIONS

Norwood Cam-Operated Series K Ribbon Imprinters (Publication Prior to 9/1/82).

*Primary Examiner*—Clifford D. Crowder

*Attorney, Agent, or Firm*—Hill, Van Santen, Steadman & Simpson

[57] ABSTRACT

A multicolor imprinter employs a plurality of heat transferable tape of different colors wound upon one another in continuous convolutions on a supply reel which has its axis of rotation parallel to the direction of travel of the tapes through a marking zone. A guide structure is provided between the supply reel and the marking zone to turn the tapes so that they are parallel and coplanar as they traverse the marking zone. A separate takeup reel is provided for each tape and has an axis of rotation perpendicular to the direction of tape travel.

22 Claims, 5 Drawing Figures

MULTICOLOR IMPRINTER

BACKGROUND OF THE INVENTION

1. Field of the Invention

The present invention relates to marking devices, and is more particularly concerned with a multicolor marking device for applying multicolor indicia to the material to be printed.

2. Description of the Prior Art

U.S. Pat. Nos. 3,823,664 and 3,881,410 to James L. Shenoha disclose a method and apparatus for imprinting information on bags prior to filling of the bags. In that system, a bellcrank mechanism is provided for causing a movable anvil to collapse a portion of an inflated bag and press a surface of the bag against a marking head. A heat transferable tape is interposed between a heated marking head and a surface of the bag so that the indicia is transferred to the surface of the bag. The system operates with a sequence which includes inflating a bag, moving an unused portion of the tape adjacent the marking head, moving the anvil into and out of the contact with the bag to press a surface of the bag between the anvil and the marking head, filling the marked bag with product, removing the bagged product and inflating the next bag to be marked and filled.

Inasmuch as it is often advantageous to have contrast in the printed matter, it would be highly expedient to be able to print two or more colors at the same time without moving the object to be printed to a separate station or stations.

SUMMARY OF THE INVENTION

It is therefore the object of the present invention to provide a method and apparatus for imprinting two or more colors in a single stamping operation.

According to the invention, a supply of heat transferable tape comprises at least two tapes of different colors wound on top of each other in continuous convolutions on a supply reel which is mounted with its axis of rotation parallel to the direction of movement of the tape through a marking zone and perpendicular to the axes of rotation of a plurality of takeup reels. Before traversing the marking zone, the plurality of tapes is separated and turned 90° by a guide so that each tape is positioned parallel and coplanar with each other tape.

BRIEF DESCRIPTION OF THE DRAWINGS

Other objects, features and advantages of the invention, its organization, construction and mode of operation will be best understood from the following detailed description, taken in conjunction with the accompanying drawings, on which.

DESCRIPTION OF THE PREFERRED EMBODIMENTS

Although the present invention is disclosed by reference to a printing device having a fixed anvil and a movable printing head, the same techniques may be employed for bags and the like using the movable anvil of the aforementioned Shenoha patents.

Figure 1:
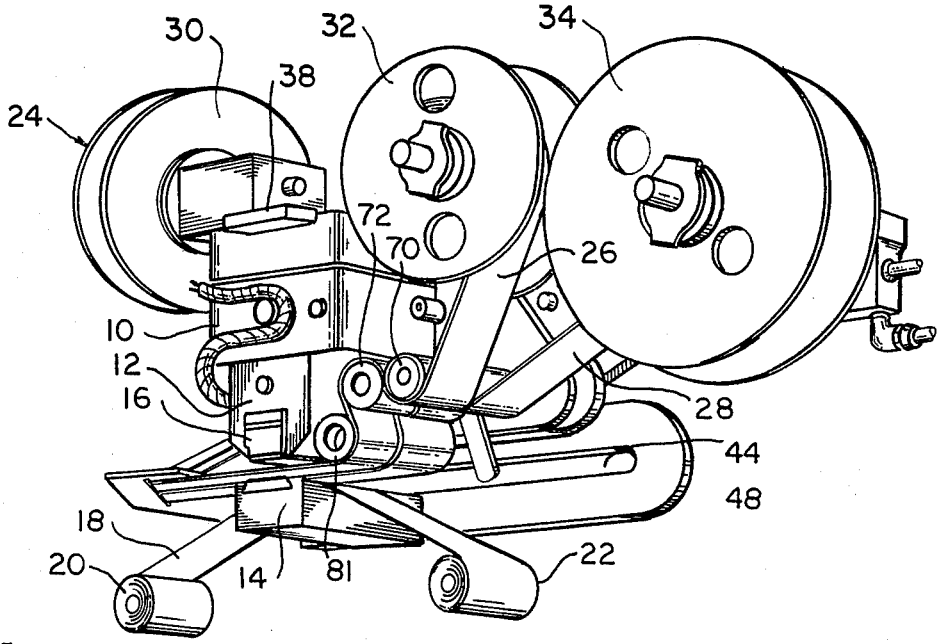
FIG. 1 is a perspective view of an imprinter constructed in accordance with the present invention.

Referring to FIG. 1, the imprinter comprises a frame 10 which slidably mounts a marking head 12 for up and down movement toward an anvil 14. The marking head 12 carries replaceable marking indicia 16 of the information to be printed. The material to be printed is symbolically illustrated at 18 as coming from a supply 20 and being deposited at a receptacle 22.

A tape supply 24 has a plurality of tapes of different colors, here two tapes 26, 28 wound one on top of the other in continuous convolutions on a supply reel 30. The reel 30 is mounted with its axis of rotation perpendicular to that of the axes of rotation of a pair of takeup reels 32, 34.

Figure 2:
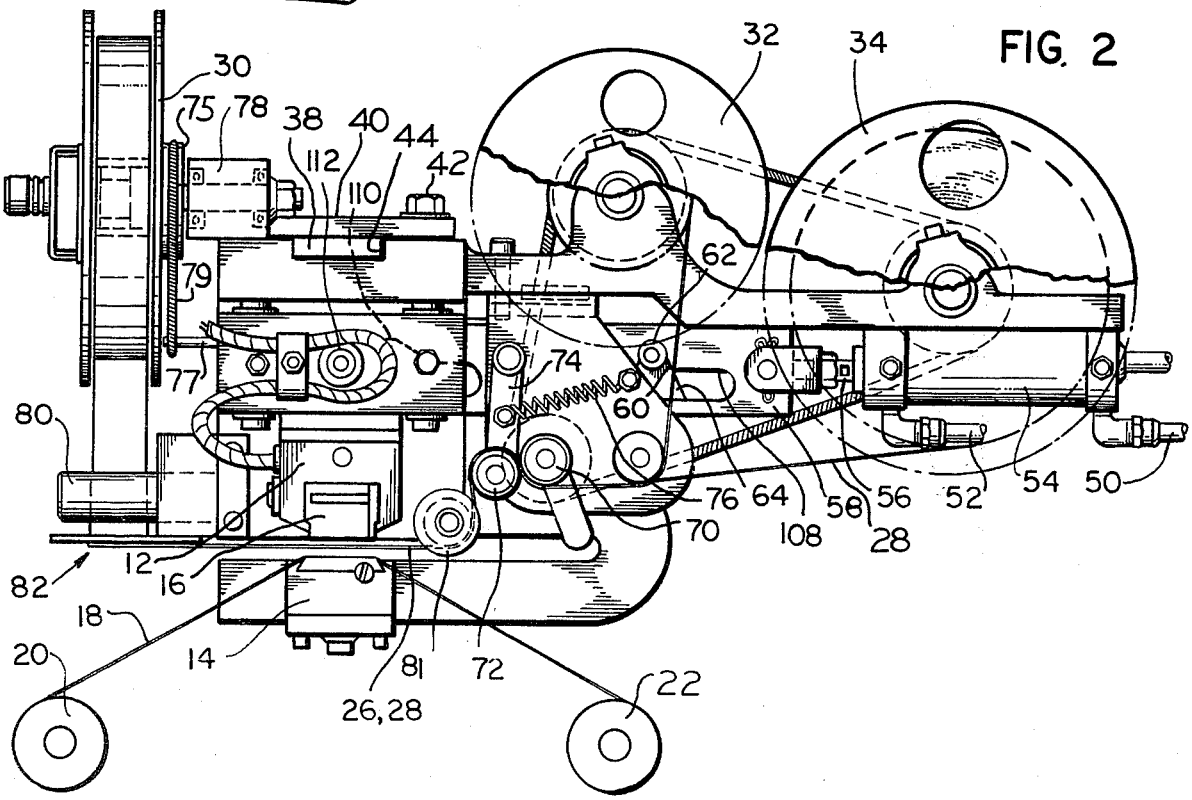
FIG. 2 is a front elevation of the apparatus of FIG. 1, shown partially broken away to illustrate the various operating mechanisms.
Figure 4:
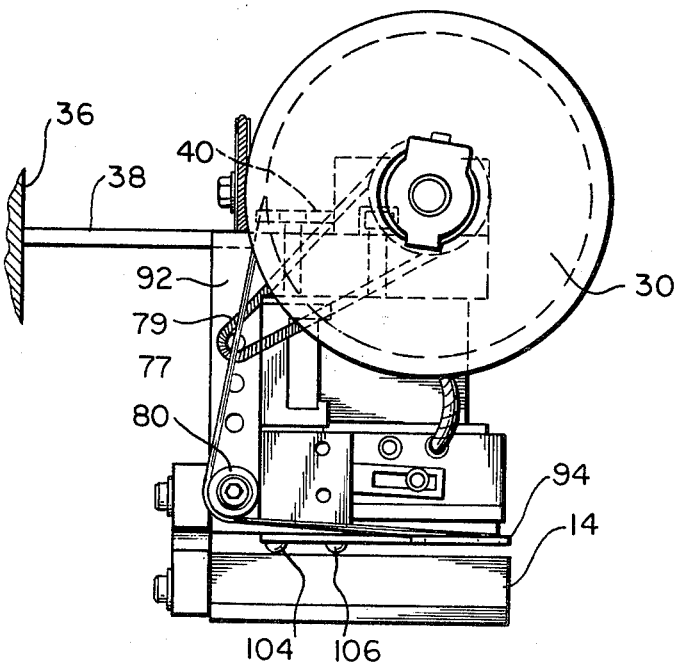
FIG. 4 is a left-hand end view of the apparatus illustrated in FIGS. 1, 2 and 3.

As illustrated in FIGS. 1, 2 and 4 in particular, the printer may be slidably mounted for movement towards and away from a wall or the like 36 by way of a bar 38 and a clamp strap 40 and bolts 42, the bar 38 extending through a slot 44.

As mentioned above, if bags are to be printed, a separate, movable anvil replaces the fixed anvil 14 and is provided with an operating mechanism, such as a bellcrank operated by a pneumatic cylinder. If a strip of labels or the like are to be printed, the elements 20 and 22 will be constituted by supplying takeup reels having a drive mechanism adapted to the printing sequence. In the present embodiment, the latter situation is considered.

Referring to FIG. 2, a cyclically operated air supply (not shown) is connected to a pair of lines 50, 52 of a pneumatic cylinder 54. The pneumatic cylinder 54 comprises an extensible member 56 which is connected to a shuttle 58. The shuttle 58 includes a cam 60 which, as the shuttle moves towards the left, operates a cam follower 62 carried by a lever 64 to operate a tape advance mechanism which comprises a pair of one-way clutches 66 and 68. The tape advance mechanism may be that disclosed in U.S. Pat. No. 3,878,776 to Schneider, fully incorporated herein by this reference, in which the lever 64 corresponds to the lever 94 of Schneider. The one-way clutch 68 is connected to rotate, step-wise, a drive roller 70 which forms a drive nip with a roller 72 carried by a pivotally mounted lever 74 and biased toward the roller 70 by way of a spring 76.

The supply reel 30 is provided with a braking mechanism including a pulley 75, an anchor stud 77 and a friction belt 79 78 so as to prevent freewheeling as the tape is stepped therefrom and directed about a guide roller 80 before traversing the guide structure 82 and a roller 81.

The one-way clutch 68 also drives the takeup reels 32 and 34 by way of an endless spring 84 which is received about a drive pulley 86 and about a pair of driven pulleys 88 and 90 which respectively drive the reels 32 and 34.

Figure 3:
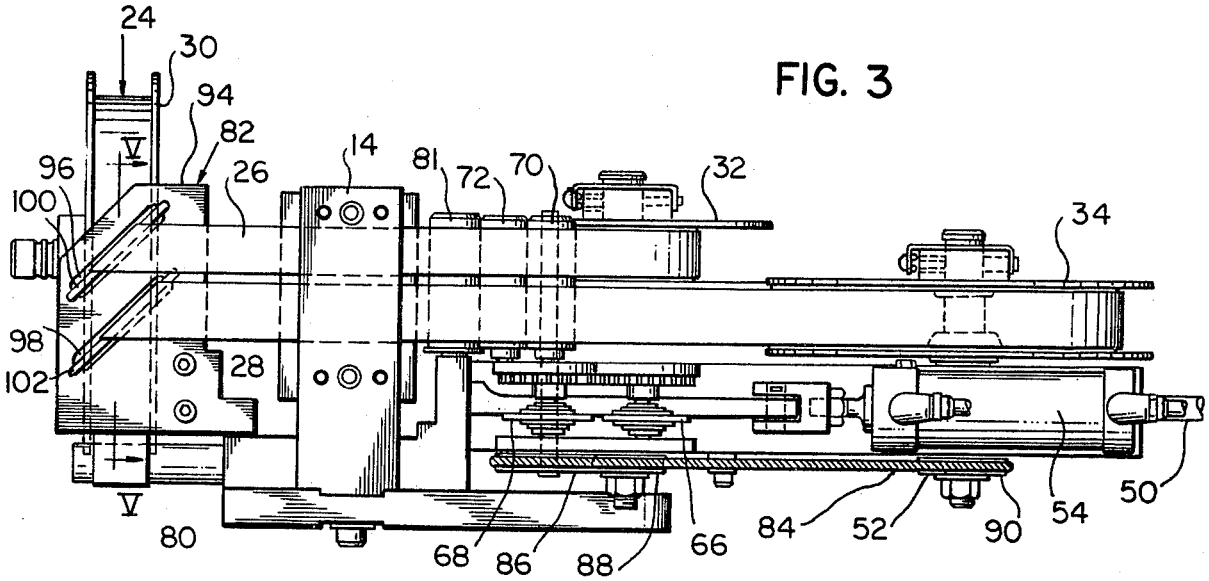
FIG. 3 is a bottom view of the apparatus of FIG. 1.
Figure 5:
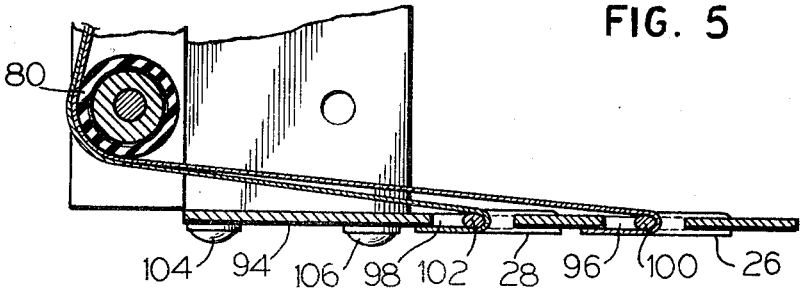
FIG. 5 is a sectional view of the guide structure taken generally along the line V—V of FIG. 3.

FIGS. 3, 4 and 5 illustrate the guide structure 82 in greater detail. The guide structure 82 comprises a member 92 connected to the frame 10 and mounting the tape supply 24 having the supply reel 30. The guide structure 82 also comprises a horizontal plate 94 which has a pair of guide slots 96, 98 extending parallel to one another and at 45° to the direction of receipt of the tape and to the desired direction of travel of the tape. The guide slots 96, 98 may include respective guide pins 100, 102.

The plate 94 may be secured to the member 92 by screws or the like 104, 106.

After a fresh portion of the tape has been stepped into the marking area and used tape has been wound on the takeup reels 32, 34, the shuttle 58 continues to advance towards the left; however, there is no further downward movement of the lever 64 in that the cam 60 develops into a horizontal area 108. The left-hand portion of the shuttle 58 then becomes effective in which a similar cam/cam follower structure is provided to move the marking head 12 downwardly towards the anvil 14. This is illustrated in FIG. 2 by the broken line cam 110 which engages a cam follower 112 carried on the marking head 12.

As the extensible member 56 is retracted, the cam followers 62 and 112 return to their uppermost positions after passing their respective cams 60 and 110.

It should be pointed out that the drive roller is drawing an equal length of each tape into the marking area and that such length is being taken up by the takeup reels 32 and 34. Although the multilayer convolutions of the tape on the reel 30 are not of exactly the same length, no problems are encountered with respect to length in that the thickness of each tape makes the differences in winding length insignificant.

Although I have described my invention to particular embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. In an imprinting device of the type wherein material to be printed is moved into an impact marking zone between a movable head and a fixed head one of which includes marking indicia thereon, in which a transfer tape is moved through the marking area between the material and the marking indicia from a supply means and is received by a takeup means by a drive, the improvement wherein:

the supply means comprises a rotatable supply reel mounted with its axis of rotation parallel to the direction of tape travel through the marking zone and a plurality of transfer tapes of different colors wound upon one another as a multilayer structure on said supply reel;

and comprising a guide structure mounted between said supply reel and the marking zone including means for separating the multilayer structure into the individual tapes and directing the tapes towards the marking zone parallel and coplanar to one another, the individual tapes being positioned at the marking zone in parallel side by side coplanar relationship in a plane normal to the movement of the indicia, the indicia dimensioned to imprint the material by all of the tapes simultaneously.

2. The improvement of claim 1, wherein said means for separating and directing comprises:

a guide plate including a plurality of guide slots therein extending at 45° to the direction of travel of the plurality of tapes towards the marking zone.

3. The improvement of claim 2, wherein said means for separating and directing further comprises:

a plurality of guide pins each mounted in a respective slot to receive a respective tape thereover.

4. The improvement of claim 2, wherein said guide structure further comprises:

a guide roller mounted between said supply reel and said guide plate to receive the multilayer tape structure thereover and direct the same towards said guide slots at a slight angle with respect to the plane of said plate.

5. The improvement of claim 1, and further comprising:

a plurality of takeup reels each connected to the drive and constituting the takeup means, each of said takeup reels mounted with its axis of rotation perpendicular to the direction of tape travel through the marking zone.

6. An imprinting device for printing on material fed into a marking zone, comprising:

a frame;

a supply of transfer tape including a rotatable supply reel mounted on said frame, and a plurality of transfer tapes wound one upon the other on said supply reel to form a multilayer tape structure, the axis of rotation of said supply reel being parallel to the direction of travel of said tapes through the marking zone;

a pair of stamping elements movable relative to one another and constituting a marking head and an anvil, one of said stamping elements bearing marking indicia;

drive means mounted on said frame and connected to said stamping elements and coupled to said plurality of transfer tapes, said drive means operable to advance said tapes through the marking zone and operate said heads towards and away from one another;

guide means mounted between said supply and the marking zone to receive, turn and position the tapes parallel and coplanar before the same reach the marking zone;

the individual tapes being positioned at the marking zone in parallel side by side coplanar relationship in a plane normal to the movement of the indicia, the indicia dimensioned to imprint the material by all of the tapes simultaneously takeup means tape-wise downstream of the marking zone to receive the tapes after imprinting; and material supply means operable to supply material to be printed between said transfer tapes and said heads.

7. The imprinting device of claim 6, wherein said guide means comprises:

a guide plate generally coplanar with a plane extending through said marking zone, said guide plate carrying means for receiving the multilayer structure, separating the individual tapes and directing the separated tapes towards the marking zone.

8. The imprinting device of claim 6, wherein said guide means comprises:

a guide plate generally coplanar with a plane extending through said marking zone, and a plurality of slots in said guide plate extending at 45° with respect to the direction of tape travel through said marking zone for receiving respective tapes therethrough.

9. The imprinting device of claim 6, wherein said guide means comprises:

means mounting a plurality of guide pins at 45° with respect to the direction of tape travel through said marking zone for receiving respective tapes thereabout.

10. The imprinting device of claim 6, wherein said guide means comprises:

a guide plate generally coplanar with a plane extending through said marking zone, and a plurality of slots in said guide plate extending at 45° with respect to the direction of the tape travel through said marking zone for receivinng respective tapes therethrough, and a plurality of guide pins each mounted in a respective slot for receiving a respective tape thereabout.

11. The imprinting device of claim 6, wherein said drive means comprises:

a pair of rollers mounted to form a drive nip for receiving said tapes through said nip, at least one of said rollers being driven;

a prime mover connected to said one roller and operable to rotate the same to advance said tapes.

12. The imprinting device of claim 11, wherein said drive means further comprises:

a unidirectional clutch mechanism connected between said prime mover and said one roller.

13. The imprinting device of claim 11, wherein said drive means further comprises:

means connected between said unidirectional clutch means and said takeup means, said takeup means including a plurality of takeup reels rotated by said means to takeup used tape and mounted for rotation with their axes of rotation perpendicular to the direction of travel of said tapes.

14. The imprinting device of claim 13, and further comprising:

a first pulley connected to and driven by said one-way clutch mechanism;

a plurality of second pulleys connected to respective ones of said takeup reels; and an endless strand embracing said first and second pulleys to rotate said takeup reels.

15. In a method of imprinting material by moving the material into a marking zone along with a transfer tape and pressing the material between a pair of jaws one of which carries printing indicia, the improvement therein comprising the steps of:

providing a plurality of tapes of different colors wound on a supply reel one upon the other in a multilayer structure;

feeding the multilayer structure towards the marking zone;

separating and directing the individual tapes into the marking zone in parallel coplanar side by side relationship; and stamping the material by each of the plurality of tapes at the same time with the jaws to imprint multicolor information on the material.

16. The improved method of claim 15, wherein the steps of feeding, separating and directing are further defined as:

feeding the multilayer structure perpendicular to the direction of tape travel through the marking zone;

interposing separating elements between the tapes along its path of travel; and turning the separated tapes 90° after separation thereof.

17. The improved method of claim 15, and further comprising the steps of:

winding the individual tapes on separate reels after stamping.

18. In an imprint marker utilizing a heated type bar member having raised indicia thereof for transfer of pigment from a transfer tape to an item to be imprinted by imprint contact between the raised indicia and transfer tape and the transfer tape and item with the transfer tape withdrawn from a supply reel and rewound on a storage reel, transfer tape movement being effected by a drive roller activated by movement of a shuttle, an anvil member opposed to the type bar member and movement of the shuttle causing relative movement between the type bar member and anvil, the transfer tape passing a transfer station between the type bar member and anvil, the improvement of said supply reel carrying a plurality of individual transfer tapes, means directing transfer tape movement from the supply reel through the imprint station with the individual transfer tapes being aligned parallel to one another and coplanar in side by side relationship at the imprint station, and a plurality of storage reels for said transfer tape, each storage reel receiving a single tape and the indicia striking each tape with each imprint contact.

19. The device according to claim 18 wherein the supply reel is mounted at right angles to the storage reel.

20. The device of claim 19 wherein the plurality of individual transfer tapes are spirally interwound on the supply reel and are rewound on individual storage reels.

21. The device according to claim 20, including guide means for separating the individual transfer tapes and aligning them parallel to one another for movement through the imprint station.

22. The device according to claim 21 wherein the guide means includes at least two parallel slot members positioned at a 45° angle to the top of movement of the transfer tape through the imprint station.

* * * * *